US007238143B1

(12) United States Patent
Sokolovos et al.

(10) Patent No.: US 7,238,143 B1
(45) Date of Patent: Jul. 3, 2007

(54) BODY VIBRATION GENERATOR HAVING ATTACHMENTS FOR EXERCISES TO TARGET BODY REGIONS

(76) Inventors: Genadijus Sokolovos, 4745 Signal Rock Rd., Colorado Springs, CO (US) 80922; Nikiforas Sokolovas, Gaiziunu 60, Kaunas (LT) 3009; Birute Sokolova, 4745 Signal Rock Rd., Colorado Springs, CO (US) 80922

( * ) Notice: Subject to any disclaimer, the term of this patent is extended or adjusted under 35 U.S.C. 154(b) by 0 days.

(21) Appl. No.: 10/861,431

(22) Filed: Jun. 7, 2004

(51) Int. Cl.
*A61H 23/00* (2006.01)
*A63B 21/00* (2006.01)

(52) U.S. Cl. ..... 482/1; 601/108; 482/8

(58) Field of Classification Search ..... 601/1, 601/46, 48, 51–54, 67–73, 84, 89, 93–95, 601/108; 482/1–9
See application file for complete search history.

(56) References Cited

U.S. PATENT DOCUMENTS 4,079,733 A * 3/1978 Denton et al. ..... 601/108
4,291,686 A * 9/1981 Miyashiro ..... 601/101
4,788,968 A * 12/1988 Rudashevsky et al. ..... 601/78
5,529,552 A * 6/1996 Biedermann et al. ..... 482/51
6,350,249 B1 * 2/2002 Zicherman ..... 604/29
6,569,065 B1 * 5/2003 Menold et al. ..... 482/72
6,752,772 B2 * 6/2004 Kahn ..... 601/98
6,805,700 B2 * 10/2004 Miller ..... 606/239

* cited by examiner

*Primary Examiner*—Glenn E. Richman
(74) *Attorney, Agent, or Firm*—G. F. Gallinger

(57) ABSTRACT

A method of conditioning a body for swimming in conjunction with an inclined bench of the type having a sliding top carriage comprising the steps of: a) providing i) a vibration generation unit having a housing containing vibration generation and a vibrating member; ii) a member attachment to facilitate transmission of the generated vibration to the body; and a base for the vibration generation unit capable of orienting the vibrating member in a position generally parallel to an incline of the bench; b) orienting the vibration generation unit on the base so that its vibrating member reciprocates on a plane generally parallel to the bench; and, c) positioning and securing the vibration generation unit beneath the bench. Then a swimmer lying face down on and carried by the carriage can slide the carriage cyclically along the incline by pressing his hands on the vibrating member attachment specifically conditioning his arms and upper torso.

19 Claims, 1 Drawing Sheet

BODY VIBRATION GENERATOR HAVING ATTACHMENTS FOR EXERCISES TO TARGET BODY REGIONS

FIELD OF THE INVENTION

This invention relates to utilization of low frequency vibration to condition the body. More particularly this invention relates to a body vibration generator having interchangeable attachments which are used to condition selected body regions when exercises are done in conjunction with one of the vibrating attachments.

BACKGROUND OF THE INVENTION

In recent years the popularity of using low frequency mechanical vibration in training has been growing. Vibration training is currently a regular topic of debates in scientific conferences and coaches' clinics. Many articles have been published in scientific magazines about the beneficial effects of vibration on strength and power, flexibility, balance, rehabilitation after injuries, recovery after high intensity training, bone density, and neurophysiology including blood circulation and human growth hormone production. It has been reported that low frequency and short period muscle vibration induces improvements in strength, power, and/or flexibility similar to those observed after several weeks of heavy training.

The benefits of vibration as a training and treatment methodology have been known as early as the 60's and 70's. (Hagabarth, K. E., & G. Eklund, 1965; Coerman, R., et al., 1965; Butkovovskja, Z. M., & I. G. Boldyrev, 1967; Macchioni, P., et al., 1968; Kozminska, A., et al., 1970; Homma, S., et al., 1972; Arinchin, N. I., 1974 etc.) Russian scientist V. T. Nazarov used vibration as a training tool in gymnastics and several other sports (1983, 1984, 1987). Research demonstrates that only 10-20 minutes per day of exposure to vibration results in increasing levels of testosterone, doubling of muscle blood flow and energy metabolism, and quadrupling Human Growth Hormone production; as well as increasing bone density comparably to, hours of high impact, strenuous physical activity.

U.S. Pat. No. 6,659,918 issued to H. Scheissl discloses a vibrating platform used to run on. One of the problems with this device is that it has limited capacity to adjust frequency of vibration. While frequency in the 25-35 Hz range is optimal, a selected frequency in that range is optimal for a particular targeted effect. For example, blood flow has been documented to almost double at the lower end of this frequency range, while 35 Hz is dramatically better for neuro muscular effects. Yet another problem with Scheissl's platform is that it has minimal effect on the upper torso and arms. Genadijus Sokolovas, the inventor herein, and Director of USA Swimming, has developed a vibration generator which can target specific groups of muscles. U.S. Olympic swimmers regularly use and appreciate the benefits that this vibration generator has had on their upper torsoes and arms.

OBJECTS OF THE INVENTION

It is an object of this invention to disclose a vibrational generator which can target specific groups of muscles. It is an object of this invention to disclose a vibrational generator having interchangeable attachments, with which one can exercise in conjunction with, to dramatically increase the benefits of the exercise. Optimal vibration is superimposed on the load carried by the muscles during exercise to thereby dramatically increase the benefits of that specific exercise. It is yet a further object of this invention to disclose a multipurpose vibrational generator which can be used with selected attachments to target specific muscle groups to better thereby achieve fitness, and maximally improve, a specific sport such as swimming. The multi purpose vibration generator can be used on a base to support body weight, or alternatively it may be held suspended. One attachment facilitates holding the vibrational generator directly, suspended in one's hands. Alternatively, the vibrational generator can be suspended on one end of a cable, which after being strung through pulleys, has an opposite end which is pulled on by the body. The vibrational generator can be held suspended with or without weights attached beneath it.

One aspect of this invention provides for a method of conditioning a selected portion of the body comprises the steps of: i) providing a vibration generation unit having a housing containing vibration generation equipment including an upright vibrating member longitudinally reciprocating therein and extending out through the housing; and, ii) providing a member attachment to facilitate transmission of the generated vibration to the body. Then with different member attachments and different orientations of the vibrating member different muscles and regions of the body can be specifically conditioned.

Yet another aspect of this invention provides for a method of conditioning a body for swimming in conjunction with an inclined bench of the type having a sliding top carriage comprising the steps of: a) providing i) a vibration generation unit having a housing containing vibration generation and a vibrating member; ii) a member attachment to facilitate transmission of the generated vibration to the body; and a base for the vibration generation unit capable of orienting the vibrating member in a position generally parallel to an incline of the bench; b) orienting the vibration generation unit on the base so that its vibrating member reciprocates on a plane generally parallel to the bench; and, c) positioning and securing the vibration generation unit beneath the bench. Then a swimmer lying face down on and carried by the carriage can slide the carriage cyclically along the incline by pressing his hands on the vibrating member attachment specifically conditioning his arms and upper torso.

Various other objects, advantages and features of this invention will become apparent to those skilled in the art from the following description in conjunction with the accompanying drawings.

FIGURES OF THE INVENTION

FIG. 2 is a schematic view of a vibration generation unit adapted to attach to a cable on a top side portion and adapted to carry heavy weights. The cable is strung through pulleys before it is pulled on.

Figure 1:
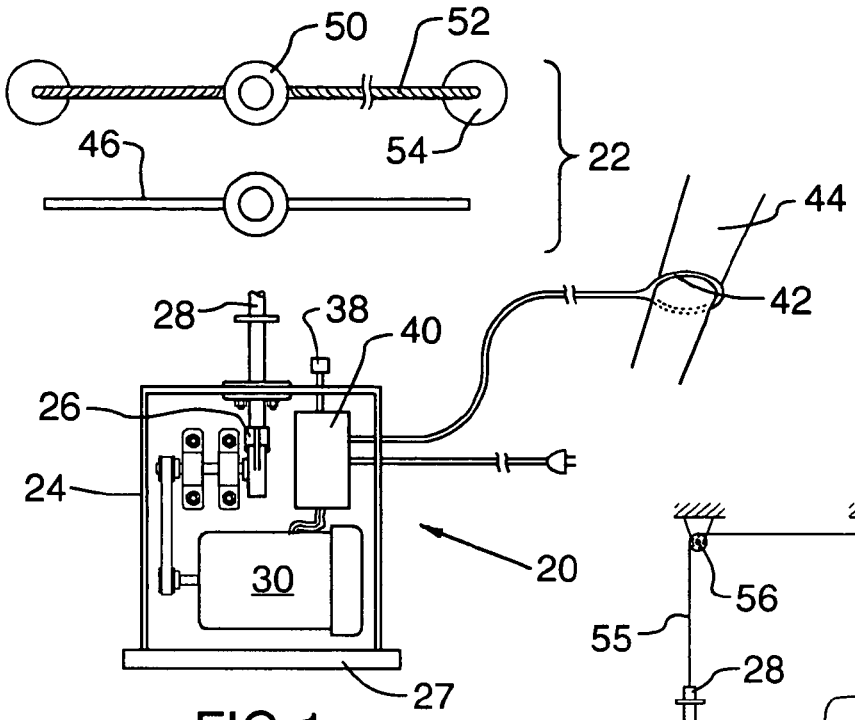
FIG. 1 is a schematic view of a vibration generation unit positioned beneath two preferred forms of vibrating member attachments.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a schematic view of a vibration generation unit 20 positioned beneath two preferred forms of vibrating member attachments 22. A method of conditioning a selected portion of the body comprises the steps of: i) providing a vibration generation unit 20 having a housing 24 containing vibration generation equipment 26 including an upright vibrating member 28 longitudinally reciprocating therein and extending out through the housing 24; and, ii) providing a member attachment 22 to facilitate transmission of the generated vibration to the body. When with different member attachments 22 and with different orientations of the vibrating member 22, different muscles and regions of the body can be specifically conditioned. In the most preferred aspect of this invention the vibration generation equipment includes an electric motor 30, and a cam 32 turned by the motor. The cam 32 causes the vibrating member 28 to cyclically and harmonically reciprocate.

When the upright member 28 vibrates with an amplitude between 2 to 12 millimeters and with a frequency between 20 and 40 Hz the body will be benefited. Benefits will be maximized when the upright member 28 vibrates with an amplitude between 4 to 10 millimeters and with a frequency between 25 and 35 Hz. In a preferred aspect of this invention the frequency of the vibration is variable within the frequency range to enable the frequency to be tuned to resonate a selected muscle of a given length and the method further comprises the step of adjusting 38 the frequency to a muscle being conditioned. In the most preferred aspect of this invention the method further comprises the step of providing an energy meter 40 and sensor 42 to measure activity in a measured muscle 44. Circuitry (not shown) may be provided to automatically tune vibration frequency to maximize activity in, or resonate the measured muscle 44.

In one aspect of this invention the vibrating member attachment 22 comprises a lateral bar 46 centrally attached to the vibrating member 28 so that opposite end portions of the bar 46 can transmit vibration to the body. It is intended that transmission to the body not only include a bar having opposite end portions which can be held in one's hands but additionally, a bar having a curvature of larger radius on opposite ends for pressing against with the palm of one's hands or the limbs of the body. In another aspect of this invention facilitate holding. The method further comprises the step of pulling on the cable with one's hands in a swimming pattern such as a breast stroke.

Figure 2:
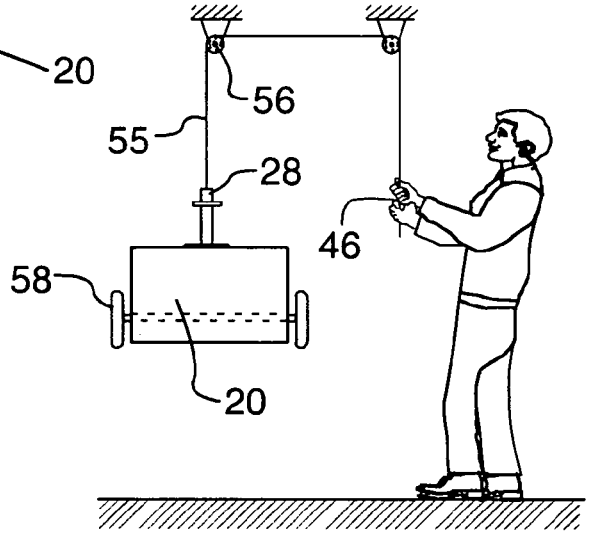

FIG. 2 is a schematic view of a vibration generation unit 20 adapted to attach to a cable 55 on a top side portion and adapted to carry heavy weights 58. The cable 55 is strung through pulleys 56 before it is pulled on. In this aspect of the invention the method further comprises the step of stringing the cable 52 through pulleys 56 before it is pulled. The vibrating member 28 further extends from a top side portion of the housing 24 and a lower portion of the housing 24 is adapted to removably carry heavy discs 58 so that the vibration generation unit 20 is suspended. A swimmer 64 pulls downwardly on a lateral bar 46 centrally attached to cable 55.

Figure 3:
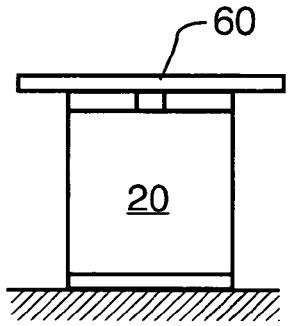
FIG. 3 is an elevational view of a vibration generation unit having a platform which is a top and integrated side portion of the vibration generation unit.

FIG. 3 is an elevational view of a vibration generation unit 20 having a platform 60 which is a top and integrated side portion of the vibration generation unit 20. The vibrating platform 60 could be seated on to improve spinal bone density. Alternatively it could be seated on to lift weights.

Figure 4:
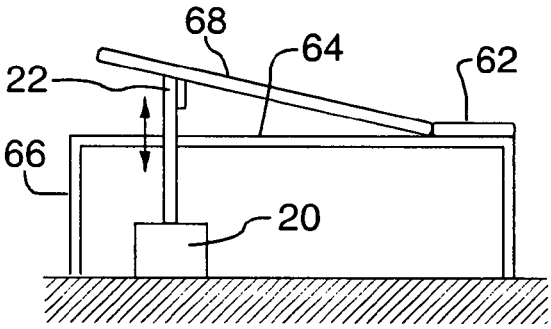
FIG. 4 is an elevational view of the vibration generation unit positioned beneath a weight bench.

FIG. 4 is an elevational view of the vibration generation unit 20 positioned beneath a weight bench 62. A method of conditioning a body in conjunction with a weight lifting bench 62 of the type having a frame 64, front and rear legs 66 extending downwardly from the frame 64, and a top side portion having a top end portion 68 which hinges upwardly above the frame 64, comprising the steps of: providing a vibration generation unit from the frame 64, and a top side portion having a top end portion 68 which hinges upwardly above the frame 64, comprising the steps of: providing a vibration generation unit 20 having a housing 24 containing vibration generation equipment 26 including an upright vibrating member 28 longitudinally reciprocating therein and extending out through the housing 24, an electric motor 30, and a cam 32 turned by the motor 30, and wherein the cam 32 causes the vibrating member 28 to cyclically and harmonically reciprocate; providing a base 27 for the vibration generation unit 20 configured to orient the vibrating member on a top portion of the unit 20; providing a member attachment 22 to facilitate transmission of the generated vibration to a bottom side portion of a top end portion the bench 62; positioning the vibration generation unit 20 beneath the bench 62; and, attaching the member attachment 22 to a bottom side portion of a top end portion the bench 62. When a person on the bench lifts weights 28 vibrations are transmitted through the person's body between the bench and the lifted weight 28.

Figure 5:
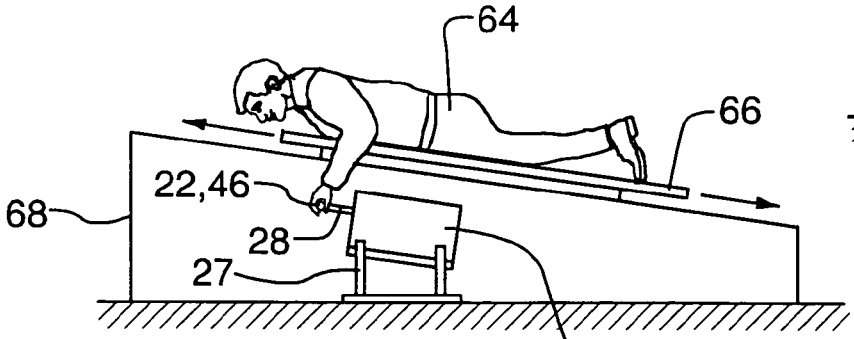
FIG. 5 is a schematic elevational view of a swimmer carried on the carriage of an inclined bench. He is cyclically sliding the carriage by pressing on the vibrating member attachment.

FIG. 5 is a schematic elevational view of a swimmer 64 carried on the carriage of an inclined bench 68. The swimmer 64 is cyclically sliding the carriage 66 by pressing on the vibrating member attachment 22. A method of conditioning a body for swimming in conjunction with an inclined bench 68 of the type having a sliding top carriage 66 comprises the steps of: providing i) a vibration generation unit 20 having a housing 24 containing vibration generation equipment 26 including an upright vibrating member 28 longitudinally reciprocating therein and extending out through the housing 24, an electric motor 30, and a cam 32 turned by the motor 30, and wherein the cam 32 causes the vibrating member 28 to cyclically and harmonically reciprocate; ii) a member attachment 22 to facilitate transmission of the generated vibration to the body; and a base 27 for the vibration generation unit 20 capable of orienting the vibrating member 28 in a position generally parallel to an incline of the bench 68; orienting the vibration generation unit 20 on the base 27 so that its vibrating member 28 reciprocates on a plane generally parallel to the bench 68; and, positioning and securing the vibration generation unit 20 beneath the bench 68. When a swimmer 64 lying face down on and carried by the carriage 64 slides the carriage 66 cyclically along the incline by pressing his hands on the vibrating member attachment 28 his upper body is conditioned. With the inclined bench 68 either one of the vibrating member attachments 22 which comprises a lateral bar centrally attached to the vibrating member 28 or a cable attachment 50 having two cables 52 having hand holds to facilitate holding the cables 52 are used.

While the invention has been described with preferred specific embodiments thereof, it will be understood that this description is intended to illustrate and not to limit the scope of the invention, which is defined by the following claims.

We claim:

1. A method of conditioning muscles in a selected portion of the body comprising the steps of:

i) providing a vibration generation unit having a housing containing vibration generation equipment including an upright vibrating member longitudinally reciprocating therein with an amplitude of longitudinal motion, and extending out through the housing; said vibrating member having an axis angularly oriented to selectively vibrate the muscles in the selected portion of the body;

ii) vibrating the upright member with an amplitude between 2 to 12 millimeters and with a frequency between 20 and 40 Hz; and, iii) centrally attaching a lateral member directly to the vibrating member so that opposite ends of the lateral member can be held/pushed with one's hands and so that the full amplitude of longitudinal motion of the vibrating member is wholly transmitted to the lateral member; and, so that during exercise selected muscles in a region of the body are specifically conditioned.

2. A method as in claim 1 wherein the vibration generation unit comprises a base capable of orienting the housing in varying positions so that the angular orientation of the axis of the vibrating member can be chosen to selectively vibrate muscles in varying regions of the body.

3. A method as in claim 1 wherein the vibrating member has a non-vertical orientation to facilitate transmission of non-vertical vibration to selected muscles and regions of the body.

4. A method as in claim 1 wherein the lateral member is removably and lockably attachable to the upright member to facilitate vibrating the body with attachments other than the lateral member.

5. A method as in claim 1 wherein the upright member vibrates with an amplitude between 4 to 10 millimeters and with a frequency between 25 and 35 Hz.

6. A method as in claim 1 wherein the frequency of the vibration is variable within the frequency range to enable the frequency to be tuned to resonate a selected muscle of a given length, and further comprising the step of adjusting the frequency to a muscle being conditioned.

7. A method as in claim 6 further comprising the step of providing an energy meter and sensor to measure muscle activity in an exercised muscle and thereafter tuning vibration frequency to maximize or resonate that measured muscle activity.

8. A method as in claim 1 of conditioning the arms for swimming in conjunction with an inclined bench of the type having a sliding top carriage further comprising the steps of:

a) orienting the vibration generation unit so that the vibrating member moves generally parallel to an incline of the bench; and, b) positioning and securing the vibration generation unit beneath the bench;

so that a swimmer lying face down on and carried by the carriage can slide the carriage cyclically up along the incline by pressing his hands on opposite end portions of the vibrating lateral member.

9. A method of conditioning a selected portion of the body comprising the steps of:

i) providing a vibration generation unit having a housing containing vibration generation equipment including an upright vibrating member longitudinally reciprocating therein with an amplitude of longitudinal motion, and extending out through the housing;

ii) attaching a cable to directly to the vibrating member so that the full amplitude of longitudinal motion of the vibrating member is wholly transmitted to the cable to thereby facilitate full transmission of the amplitude of the generated vibration to selected muscles in a region of the body; is transmitted to the cable to facilitate transmission of the generated vibration to selected muscles in a region of the body;

iii) vibrating the upright member with an amplitude between 2 to 12 millimeters and with a frequency between 20 and 40 Hz;

so that the selected muscles and region of the body can be specifically conditioned.

10. A method as in claim 9 wherein the vibrating member has a non-vertical orientation to facilitate transmission of non-vertical vibration to selected muscles and regions of the body.

11. A method as in claim 9 wherein the vibration generation unit comprises a base capable of orienting the housing in varying positions so that the angular orientation of the axis of the vibrating member can be chosen to selectively vibrate muscles in varying regions of the body.

12. A method as in claim 9 further comprising the step of stringing the cable through pulleys before it is pulled and wherein the vibrating member further extends from a top side portion of the housing and wherein a lower portion of the housing is adapted to removably carry heavy discs so that the vibration generation unit can be suspended.

13. A method as in claim 9 wherein the attached cable comprises two cables and wherein an unattached end portion of each cable terminates in hand hold.

14. A method as in claim 13 of conditioning the arms for swimming in conjunction with an inclined bench of the type having a sliding top carriage further comprising the steps of:

a) orienting the vibration generation unit so that the vibrating member moves generally parallel to an incline of the bench; and, b) positioning and securing the vibration generation unit beneath the bench;

so that a swimmer lying face down on and carried by the carriage can slide the carriage cyclically up along the incline by pulling on the hand holds.

15. A method as in claim 14 further comprising the step of the swimmer pulling on the cable with one's hands in a swimming arm pattern such as a breast stroke.

16. A method as in claim 8 wherein the lateral member is removably and lockably attachable to the upright member to facilitate vibrating other attachments than the lateral member.

17. A method as in claim 8 wherein the upright member vibrates with an amplitude between 4 to 10 millimeters and with a frequency between 25 and 35 Hz.

18. A method as in claim 9 wherein the frequency of the vibration is variable within the frequency range to enable the frequency to be tuned to resonate a selected muscle of a given length, and further comprising the step of adjusting the frequency to a muscle being conditioned.

19. A method as in claim 18 further comprising the step of providing an energy meter and sensor to measure muscle activity in an exercised muscle and thereafter tuning vibration frequency to maximize or resonate that measured muscle activity.

* * * * *